US006070386A

United States Patent [19]

Spatafora et al.

[11] Patent Number: 6,070,386

[45] Date of Patent: Jun. 6, 2000

[54] UNIT FOR COMBING WRAPPED CHOCOLATES

[75] Inventors: Mario Spatafora, Bologna; Luca Borderi, Sasso Marconi, both of Italy

[73] Assignee: Azionaria Costruzioni Macchine Automatiche A.C.M.A. S.p.A., Bologna, Italy

[21] Appl. No.: 09/061,571

[22] Filed: Apr. 16, 1998

[30] Foreign Application Priority Data

Apr. 17, 1997 [IT] Italy ..... BO97A0229

[51] Int. Cl.[7] ..... B65B 11/34; B65B 51/00

[52] U.S. Cl. ..... 53/225; 53/217; 53/227

[58] Field of Search ..... 53/227, 225, 217, 53/223, 222, 221, 220, 234, 465, 464, 461, 439, 528, 526, 530; 493/406

[56] References Cited

U.S. PATENT DOCUMENTS

| | | | |
|---|---|---|---|
| 2,627,709 | 2/1953 | Schlicksupp | 53/225 X |
| 3,899,865 | 8/1975 | Revaz | 53/225 |
| 4,085,567 | 4/1978 | Putnam, Jr. et al. | 53/225 |
| 5,271,205 | 12/1993 | Spatafora et al. | 53/225 X |

FOREIGN PATENT DOCUMENTS

| | | | |
|---|---|---|---|
| 0 733 548 A1 | 9/1996 | European Pat. Off. . | |
| 650989 | 2/1929 | France | 53/227 |

*Primary Examiner*—James F. Coan

*Attorney, Agent, or Firm*—Christensen O'Connor; Johnson & Kindness PLLC

[57] ABSTRACT

A unit for combing wrapped chocolates, wherein a combing drum, rotating continuously about a respective axis, has a number of combing devices, each of which has a gripping device rotating, crosswise to the aforementioned axis, between a radial gripping position to grip a chocolate, and an axial release position located along an axial path parallel to the aforementioned axis and along which travel a pusher and a counter-pusher; the path extending through an annular combing element.

7 Claims, 2 Drawing Sheets

UNIT FOR COMBING WRAPPED CHOCOLATES

BACKGROUND OF THE INVENTION

The present invention relates to a unit for combing wrapped chocolates.

In particular, the present invention relates to a unit whereby chocolates, wrapped in substantially metallic sheet material, are fed axially through an annular combing element for smoothing out any creases or unevenness on a lateral surface of the chocolates.

The above process is normally performed on a combing unit comprising a combing drum rotated in steps about a respective axis of rotation. At each step, a chocolate for combing is loaded onto the drum, in a direction crosswise to the axis of rotation of the drum, and is fed in steps about the axis of the drum to a combing station where each chocolate is fed, crosswise to the axis of the drum, through an annular combing element located in a fixed position at the combing station.

Units of the above type are fairly slow, on account of each combing operation requiring a stop between two successive steps of the combing drum. Moreover, the stop itself is also fairly long by comprising the time taken for a movable element supporting the chocolate to move, crosswise with respect to the drum axis, from an initial rest position to a work position to feed the chocolate through the annular combing element, and the time taken for the same supporting element to disengage the annular combing element and move back into the initial rest position.

One way of increasing the speed of combing units of the above type is to accelerate the steps between one stop and the next. Over a given limit, however, the sharp acceleration and deceleration to which the combing drum would be subjected would result in mechanical damage to the combing unit or in severe stress and irreparable damage to the chocolates.

SUMMARY OF THE INVENTION

It is an object of the present invention to provide a combing unit which is at once fast-operating and mechanically reliable.

According to the present invention, there is provided a unit for combing wrapped chocolates, the unit comprising a combing drum rotating continuously about a first axis and having at least one combing device; and the combing device comprising first gripping means for gripping said chocolate, first actuating means for moving said first gripping means along a path extending along a second axis through a gripping position, and an annular combining element located along said path.

According to a preferred embodiment of the above combing unit, said combing device also comprises second gripping means for gripping said chocolate; and second actuating means for moving said second gripping means between a radial loading position for loading said chocolate, and an axial release position, along said path, for releasing said chocolate.

More specifically, the combing unit preferably comprises a number of combing devices equally spaced about the first axis; and each of said second gripping means is fitted to said drum to rotate, by virtue of the respective said second actuating means, about a respective third axis crosswise to the first axis.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
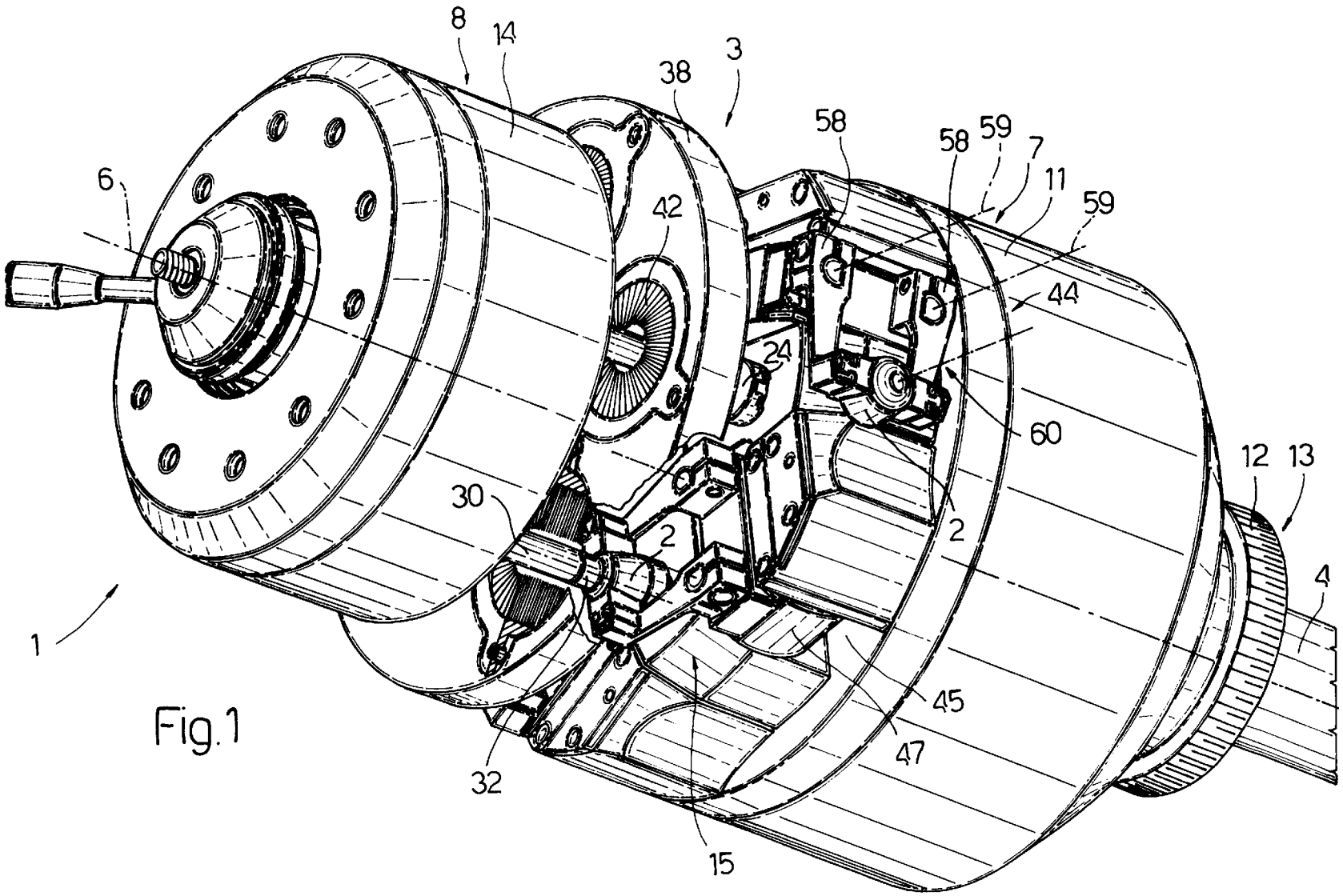
FIG. 1 shows a view in perspective, with parts removed for clarity, of a preferred embodiment of the combing unit according to the present invention.
Figure 2:
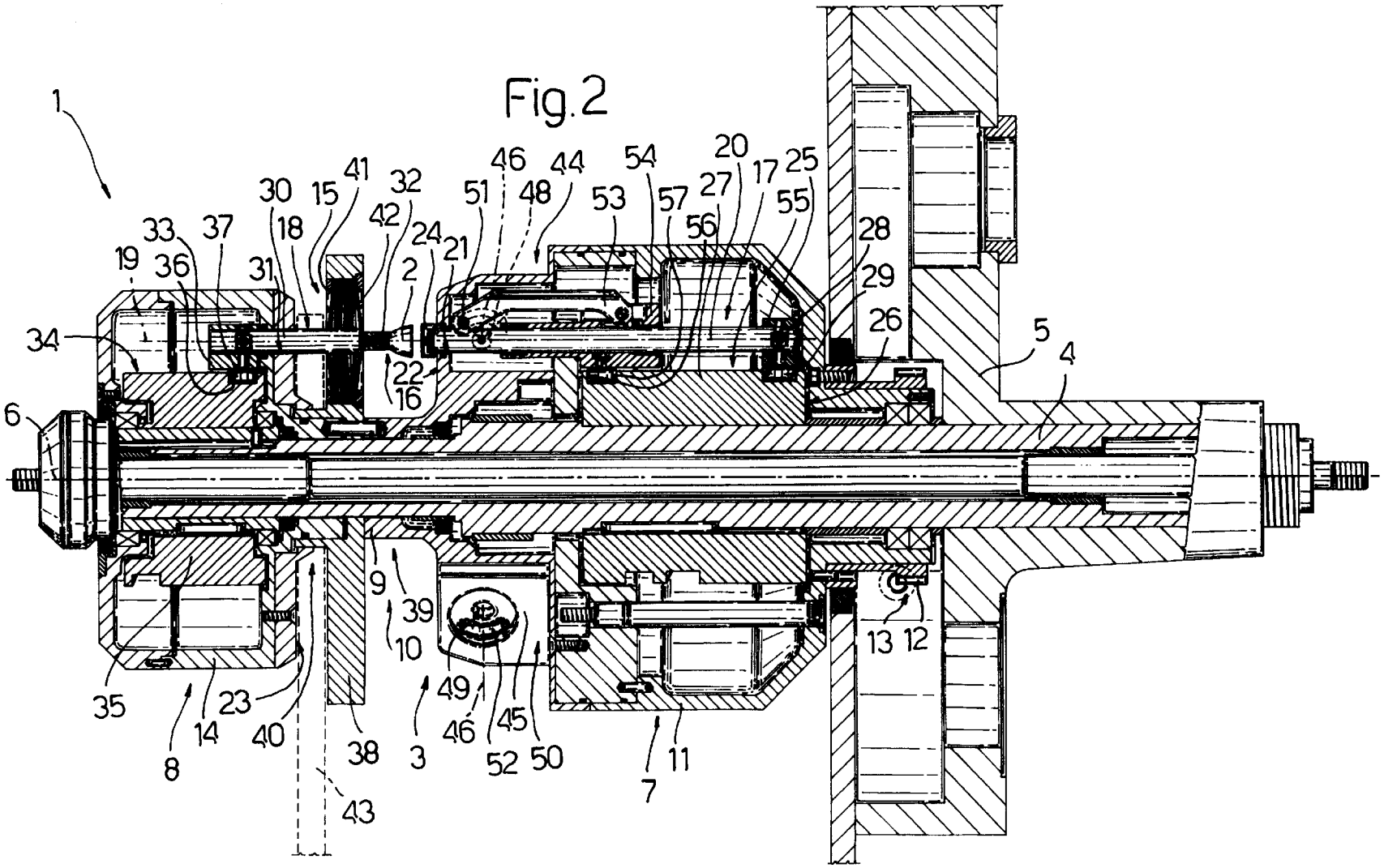
FIG. 2 shows a schematic axial section of the FIG. 1 unit.

Number 1 in the accompanying drawings indicates as a whole a unit for combing wrapped chocolates 2 and defining an output unit of a wrapping machine (not shown).

Unit 1 comprises a combing drum 3 mounted for rotation on a central shaft 4 fitted in fixed manner to a frame 5 and coaxial with an axis 6 defining the axis of rotation of drum 3.

Drum 3 comprises a first and a second half-drum 7 and 8 connected integrally to each other by a sleeve 9 smaller in diameter than half-drums 7 and 8 and defining the bottom wall of an annular groove 10 extending about axis 6.

Half-drum 7 is interposed between half-drum 8 and frame 5, and comprises a substantially cylindrical bell 11 fitted, on the end facing frame 5, with a gear 12 defining the output element of a drive assembly 13 for rotating drum 3 continuously about axis 6. Similarly, half-drum 8 comprises a bell 14 connected integrally to bell 11 by sleeve 9 and rotating with bell 11 about axis 6.

Drum 3 supports at least one combing device 15 or, as shown in the accompanying drawings, a number of devices 15 equally spaced about axis 6 and movable continuously about axis 6 with drum 3.

Each device 15 comprises a gripping device 16 defined by a pusher 17 and a counter-pusher 18 aligned with each other along a respective axis 19 parallel to and a given distance from axis 6. Pusher 17 comprises a rod 20 fitted in axially-sliding manner through a hole 21 formed in an end wall 22 of bell 11, which, together with sleeve 9 and an end wall 23 of bell 14, defines groove 10. In addition to rod 20, pusher 17 also comprises a head 24 located inside groove 10; and a sleeve 25 connected integrally to rod 20 inside bell 11 and defining the output element of an actuating device 26 for moving rod 20 back and forth by a length less than the width of groove 10 measured parallel to axis 19. Device 26 comprises a cylindrical cam 27 fitted in a fixed position to shaft 4 and housed inside bell 11. Cam 27 has an annular rolling track 28, which is engaged by a tappet roller 29 carried by sleeve 25, and is inclined with respect to axis 6 so as to move rod 20 back and forth, as described above, in the course of a 360° movement of rod 20 about axis 6.

Counter-pusher 18 comprises a rod 30 fitted in axially-sliding manner through a hole 31 formed through end wall 23 of bell 14; a head 32 located inside groove 10; and a sleeve 33 connected integrally to rod 30 inside bell 14, and defining the output element of an actuating device 34 for moving rod 30 back and forth by a length less than the width of groove 10 measured parallel to axis 19. Device 34 comprises a cylindrical cam 35 fitted in a fixed position to shaft 4 and housed inside bell 14. Cam 35 has an annular rolling track 36, which is engaged by a tappet roller 37 carried by sleeve 33, and is inclined with respect to axis 6 so as to move rod 30 back and forth, as described above, in the course of a 360° movement of rod 30 about axis 6.

Inside groove 10, sleeve 9 is fitted with an annular plate 38, which divides groove 10 into two half-grooves 39 and 40, the first of which is adjacent to wall 22. Plate 38 comprises a number of through holes 41, each of which is coaxial with a respective axis 19 and is engaged by an annular combing element or brush 42 having a central hole smaller in diameter than chocolate 2.

Tracks 28 and 36 are so formed as to move heads 24 and 32 of each device 16 axially and substantially in time with each other, so that heads 24 and 32 grip chocolate 2 axially in a gripping position inside half-groove 39, and feed chocolate 2 along respective axis 19 and through the central hole of respective brush 42 into an unloading position inside half-groove 40 and in which chocolate 2 is intercepted by an unloading conveyor 43 substantially crosswise to axis 6 and having an input portion in a fixed position along half-groove 40.

Each combing device 15 also comprises a further gripping device 44, which is fitted in rotary manner to half-drum 7 in a respective seat 45 formed in wall 22, between two successive holes 21, so as to oscillate, about a respective axis 46 crosswise to axis 6, between a radial loading position and an axial release position.

In the loading position, device 44 is located outside drum 3 to receive and radially grip a chocolate 2 oriented substantially radially with respect to axis 6. In the release position, device 44 is located inside half-groove 39, and provides for engaging chocolate 2 radially and maintaining chocolate 2 oriented parallel to axis 6.

Device 44 comprises a substantially cylindrical body 47 coaxial with axis 46 and fitted to a central shaft 48, which is coaxial with axis 46 and engages in rotary manner a circular through hole 49 formed through a wall 50 of seat 45. Body 47 is fitted integrally with a pin 51 extending parallel to shaft 48 and engaging in transversely-sliding manner a guide slot 52 extending along an arc centered about axis 46. Pin 51 also engages in rotary manner a transverse through hole formed in one end of a transmission rod 53, the other end of which is hinged to a sleeve 54 fitted in sliding manner to rod 20 of a respective pusher 17 and defining the output element of an actuating device 55 for oscillating device 44 as described above.

Device 55 comprises a further annular track 56 formed in cam 27; and a tappet roller 57 carried by sleeve 54 and engaged in rolling manner inside track 56, which is so inclined with respect to axis 6 as to oscillate body 47, as described above, in the course of a 360° movement of device 44 about axis 6.

Each device 44 comprises a pair of gripping arms 58, which are fitted in rotary manner to body 47 and activated (in known manner not shown) to rotate about respective axes 59 crosswise to axis 46. Arms 58 define a gripper 60 for radially gripping a respective chocolate 2 in said radial loading position, in which arms 58 define a plane substantially tangent to half-drum 7 and parallel to axis 6, and for releasing chocolate 2 in said axial release position, in which arms 58 are positioned inside half-groove 39 and define a plane crosswise to axis 6.

In actual use, as stated, each chocolate 2 is fed into the loading position oriented substantially radially with respect to axis 6, and is gripped radially by respective gripper 60. Once chocolate 2 is gripped, gripper 60 is rotated by actuating device 55 about axis 46 to transfer chocolate 2 into half-groove 39 and into a release position in which chocolate 2 is positioned with its axis parallel to axis 6 and coaxial with respective axis 19. In this position, chocolate 2 is located between heads 24 and 32 of respective gripping device 16, which is closed by actuating devices 26 and 34 to axially grip and withdraw chocolate 2 from gripper 60 by which chocolate 2 is released. At this point, actuating devices 26 and 34 move respective pusher 17 and counter-pusher 18 towards half-groove 40 so as to feed chocolate 2 axially and parallel to axis 6 through respective brush 42.

Once combed, chocolate 2 is fed continuously by respective gripping device 16 along half-groove 40 and about axis 6 up to unloading conveyor 43, onto which chocolate 2 is then released.

One advantage of the combing unit described above lies in the fact that, to perform the combing operations, the first gripping means 16 move parallel to axis 6 of drum 3, which, with no substantial variation in the moment of inertia of drum 3, therefore enables the use not only of a continuously-moving drum, but also of a drum of relatively small radial size.

We claim:

1. A unit for combing wrapped chocolates, the unit comprising a combing drum (3) rotating continuously about a first axis (6) and having at least one combing device (15); the combing device (15) comprising first gripping means (16) for gripping said chocolate (2), first actuating means (26, 34) for moving said first gripping means (16) along a path extending along a second axis (19) through a gripping position, an annular combing element (42) located along said path: a second gripping means (44) for gripping said chocolate (2); and second actuating means (55) for moving said second gripping means (44) between a radial loading position for loading said chocolate (2) and an axial release position along said path. for releasing said chocolate (2); each of said second gripping means (44) being fitted to said drum (3) to rotate by virtue of the respective said second actuating means (55), about a respective third axis (46) crosswise to the first axis (6).

2. A unit as claimed in claim 1, wherein said first gripping means (16) comprise a pusher (17) and a counter-pusher (18) movable axially and substantially in time with each other along said path extending along the second axis (19), and parallel to the first axis (6).

3. A unit as claimed in claim 1, wherein said unit comprises a number of combing devices (15) equally spaced about the first axis (6).

4. A unit as claimed in claim 2, wherein said drum (3) comprises a first and a second half-drum (7, 8) coaxial with each other along the first axis (6) and integral with each other to rotate about the first axis (6), said half-drums (7, 8) defining an annular groove (10) coaxial with the first axis (6); and a plate (38) coaxial with said half-drums (7, 8) and located in an intermediate position inside said groove (10) to divide the groove into two half-grooves (39, 40); the plate (38) supporting a comb element (42) for each said combing device (15); the pusher (17) and counter-pusher (18) of each said combing device (15) being supported one by the first and the other by the second of said half-drums (7, 8); and said first gripping means (16) being movable between said gripping position and an unloading position, which are located one inside a first of said half-grooves (39, 40) and the other inside a second of said half-grooves (39, 40).

5. A unit as claimed in claim 1, wherein said first and second actuating means (26, 34; 55) are reciprocating cam actuating means.

6. A unit as claimed in claim 5, wherein said cam means comprise at least one fixed drum cam (27, 35) coaxial with the first axis (6).

7. A unit as claimed in claim 4, wherein said unit further comprises unloading conveying means (43) having an input portion extending inside said second half-groove (40).

* * * * *

UNITED STATES PATENT AND TRADEMARK OFFICE

CERTIFICATE OF CORRECTION

PATENT NO. : 6,070,386

DATED : June 6, 2000

INVENTOR(S) : M. Spatafora et al.

It is certified that error appears in the above-identified patent and that said Letters Patent is hereby corrected as shown below:

| COLUMN | LINE | |
|---|---|---|
| Pg. 1, col. 2 | Attorney, Agent or Firm | after "O'Connor" delete ";" |
| 4 (Claim 1, | 24 line 9) | "path:" should read --path;-- |
| 4 (Claim 1, | 28 line 13) | "path." should read --path,-- |
| 4 (Claim 1, | 30 line 15) | after "rotate" insert --,-- |

Signed and Sealed this

Twenty-second Day of May, 2001

*Attest:*

Nicholas P. Godici

NICHOLAS P. GODICI

*Attesting Officer*

*Acting Director of the United States Patent and Trademark Office*